US007963293B2

(12) United States Patent
Ma

(10) Patent No.: US 7,963,293 B2
(45) Date of Patent: Jun. 21, 2011

(54) UMBRELLA OPENING AND CLOSING DEVICE

(76) Inventor: Oliver Joen-an Ma, Arcadia, CA (US)

( * ) Notice: Subject to any disclaimer, the term of this patent is extended or adjusted under 35 U.S.C. 154(b) by 36 days.

(21) Appl. No.: 11/216,535

(22) Filed: Aug. 31, 2005

(65) Prior Publication Data

US 2006/0090784 A1 May 4, 2006

(30) Foreign Application Priority Data

Nov. 4, 2004 (CN) ..... 2004 2 0107976 U

(51) Int. Cl.
*A45B 25/14* (2006.01)

(52) U.S. Cl. ..... 135/20.3; 135/37; 135/98

(58) Field of Classification Search ..... 135/15.1, 135/98, 37, 20.3
See application file for complete search history.

(56) References Cited

U.S. PATENT DOCUMENTS

| | | | |
|---|---|---|---|
| 229,685 | A | 7/1880 | Ege |
| 521,222 | A | 6/1894 | Schof et al. |
| 620,815 | A | 3/1899 | Warren |
| 776,352 | A | 11/1904 | Rogers |
| 928,169 | A | 7/1909 | Bardon |
| 1,001,076 | A | 8/1911 | Redford |
| 1,207,649 | A | 12/1916 | South |
| D56,043 | S | 8/1920 | Weinberg et al. |
| 1,712,430 | A | 5/1929 | Giszczynski |
| 1,908,453 | A | 5/1933 | Schmidt |
| 2,168,188 | A | 8/1939 | Bernhard |
| 2,185,466 | A | 1/1940 | Jostes |
| 2,474,516 | A | 6/1949 | Daniel |
| 2,507,919 | A | 5/1950 | Mazzeo |
| 2,661,752 | A | 12/1953 | Kampf et al. |
| 2,705,967 | A | 4/1955 | Zimmermann et al. |
| 2,860,647 | A | 11/1958 | Negri |
| 2,906,277 | A | 9/1959 | Militano |
| 3,016,910 | A | 1/1962 | Rosenkaimer |

(Continued)

FOREIGN PATENT DOCUMENTS

AU 702 172 B2 2/1999

(Continued)

OTHER PUBLICATIONS

European Search Report dated Mar. 20, 2006 regarding Application No. EP 05255342.7-2313.

(Continued)

*Primary Examiner* — David Dunn
*Assistant Examiner* — Noah Chandler Hawk
(74) *Attorney, Agent, or Firm* — Knobbe, Martens, Olson & Bear LLP

(57) ABSTRACT

An umbrella is provided that includes a support pole assembly, a canopy support frame, and an actuating handle. The support pole assembly includes a lower pole and an upper pole. The lower pole has a lower end and an upper end. The upper pole is vertically translatable relative to the lower pole. The canopy support frame includes an upper hub, a lower hub, and a middle hub. The upper hub is coupled with the upper pole and with a plurality of ribs. The lower hub is coupled with the ribs. The middle hub is coupled with the lower pole and with the ribs. The actuating handle is coupled with the upper pole and is translatable relative to the lower pole so that, when the actuating handle is raised, the upper pole and the upper hub are raised causing the canopy support frame to close.

23 Claims, 12 Drawing Sheets

U.S. PATENT DOCUMENTS

| | | | | |
|---|---|---|---|---|
| 3,672,381 | A | 6/1972 | Kida et al. | |
| 3,828,805 | A | 8/1974 | Thur | |
| 4,030,514 | A | 6/1977 | Schultes | |
| 4,080,976 | A | 3/1978 | Hirai | |
| 4,144,900 | A | 3/1979 | Kinski | |
| 4,474,200 | A | 10/1984 | Kida | |
| 4,474,201 | A | 10/1984 | Kida | |
| 4,697,606 | A | 10/1987 | Ma | |
| 4,763,679 | A | 8/1988 | Lerch | |
| 5,036,872 | A | 8/1991 | Huang | |
| 5,329,953 | A | 7/1994 | Becher | |
| 5,483,985 | A | 1/1996 | Yu | |
| 5,564,453 | A | 10/1996 | Steiner | |
| 5,617,888 | A | 4/1997 | Wu | |
| 5,640,984 | A | 6/1997 | Dubunsky | |
| 5,655,557 | A * | 8/1997 | Martin | 135/15.1 |
| 5,740,824 | A | 4/1998 | Tang | |
| 5,752,534 | A * | 5/1998 | Becher | 135/15.1 |
| 5,842,493 | A | 12/1998 | Yakubisin | |
| 5,884,645 | A | 3/1999 | Chen et al. | |
| 6,039,063 | A | 3/2000 | Lin et al. | |
| 6,076,540 | A | 6/2000 | You | |
| 6,082,383 | A * | 7/2000 | Wilson | 135/41 |
| 6,095,169 | A | 8/2000 | Lin et al. | |
| 6,196,244 | B1 | 3/2001 | Haddad et al. | |
| 6,311,707 | B1 | 11/2001 | Wu et al. | |
| 6,374,840 | B1 | 4/2002 | Ma | |
| 6,390,107 | B1 | 5/2002 | Lin et al. | |
| 6,626,199 | B2 | 9/2003 | Lin et al. | |
| D497,478 | S | 10/2004 | Clarke | |
| 7,401,618 | B2 | 7/2008 | Caldwell | |
| 2003/0005952 | A1 | 1/2003 | Chen | |
| 2003/0098050 | A1 | 5/2003 | Lee | |
| 2004/0035452 | A1 | 2/2004 | Ma | |
| 2004/0055628 | A1 | 3/2004 | Yu | |
| 2004/0182429 | A1 | 9/2004 | Chen | |
| 2005/0028853 | A1 | 2/2005 | Houtan | |
| 2005/0045217 | A1 | 3/2005 | Clarke | |
| 2006/0151018 | A1 * | 7/2006 | Wilson | 135/16 |
| 2008/0066791 | A1 | 3/2008 | Ma | |
| 2008/0066793 | A1 | 3/2008 | Ma | |

FOREIGN PATENT DOCUMENTS

| | | | |
|---|---|---|---|
| DE | 580503 | | 7/1933 |
| DE | 203 06 406 | U1 | 7/1994 |
| DE | 20 2005 011579 | | 7/2006 |
| EP | 0 392 989 | | 3/1990 |
| EP | 1 654 952 | | 5/2006 |
| FR | 2 554 490 | | 5/1985 |
| GB | 22218 | A | 9/1910 |
| NL | 9 500 219 | A | 9/1996 |
| WO | WO 2006/076270 | | 7/2006 |
| WO | WO 2007/018492 | | 2/2007 |

OTHER PUBLICATIONS

U.S. Appl. No. 11/850,628, filed Sep. 5, 2007, Ma.

U.S. Appl. No. 11/850,640, filed Sep. 5, 2007, Ma.

International Search Report and Written Opinion in PCT Application No. PCT/US2007/077668, mailed Jan. 29, 2008.

International Search Report and Written Opinion in PCT Application No. PCT/US2007/077673, mailed Jan. 29, 2008.

International Preliminary Report on Patentability of PCT/US2007/077673, dated Mar. 19, 2009 in 7 pages.

International Preliminary Report on Patentability of PCT/US2007/077668, dated Mar. 19, 2009 in 8 pages.

* cited by examiner

UMBRELLA OPENING AND CLOSING DEVICE

CROSS-REFERENCE TO RELATED APPLICATIONS

This application claims priority under 35 U.S.C. §119(a) to Utility Model No. 200420107976.0, filed Nov. 4, 2004 in the People's Republic of China.

BACKGROUND OF THE INVENTION

1. Field of the Invention

The invention relates to the field of umbrellas and to an opening/closing mechanism for umbrellas that offers simplified opening/closing operation and securing of the umbrella in a set opening position as well as improved aesthetics.

2. Description of the Related Art

Umbrellas are popular devices which can be utilized outdoors to provide shade from the sun and shelter from the elements. Umbrellas typically include the capability to be placed in an open or erect configuration to provide the shelter and shade function, as well as to be closed or collapsed to facilitate movement and storage of the umbrellas. Many umbrellas are relatively large having canopy diameters on the order of several meters when opened to provide the desired shade and shelter. Accordingly, some type of opening mechanism is frequently provided to facilitate opening and closing of the umbrella.

A variety of opening/closing mechanisms are known for umbrellas which may include crank and pulley arrangements, levers, and/or rack and pinion arrangements. Such mechanisms tend to be relatively complex, which increases the manufacturing costs for the umbrellas and the corresponding sale or purchase price to the end user. In addition, the relatively complex mechanisms present numerous potential failure modes, as well as increased susceptibility to contamination and jamming by foreign debris material and corrosion and material degradation from environmental factors.

A further drawback to known umbrella opening/closing mechanisms is that the relatively complex mechanisms tend to result in operational structures which are not particularly aesthetically pleasing to observers. For example, crank mechanisms and lever-operated mechanisms generally include a user actuation member or crank which extends or is extendable outward to allow a user to manipulate the mechanism. However, such cranks or levers tend to be quite mechanical and utilitarian in appearance which can detract from a desirable aesthetic appearance of the overall umbrella. As umbrellas are frequently employed both for their aesthetic appearance, as well as for the utility of shade and shelter, it will be understood that a pleasing aesthetical appearance is a highly desirable feature in an umbrella.

SUMMARY OF THE INVENTION

From the foregoing, it will be appreciated that there is a desire for an umbrella opening/closing mechanism which is of simplified construction to both reduce the construction/manufacturing costs of the umbrella, as well as to reduce susceptibility to material contamination and material degradation and corrosion. It is also desirable that an umbrella opening/closing mechanism facilitate opening and closing of a relatively large umbrella without excessive applied user force, for example, by incorporating mechanical advantage. There is also a desire for an umbrella having an opening and closing mechanism which presents a pleasing symmetrical and mechanically uncluttered aesthetic appearance.

These needs are satisfied by the invention which in one embodiment includes an umbrella, comprising a support pole assembly comprising a lower pole having a lower end and an upper end, an upper pole vertically translatable relative to the lower pole, a canopy support frame comprising an upper hub coupled with the upper pole and with a plurality of ribs, a lower hub coupled with the ribs, and a middle hub coupled with the lower pole and with the ribs and an actuating handle coupled with the upper pole and translatable relative to the lower pole so that, when the actuating handle is raised, the upper pole and the upper hub are raised causing the canopy support frame to close.

Another embodiment includes an umbrella comprising a support pole, a canopy support frame comprising a hub coupled with an upper portion of the support pole and a plurality of ribs coupled with the hub, and an actuating handle coupled with the hub, the actuating handle comprising a hand-gripping portion and a frictional surface, the actuating handle having a first position with respect to the support pole in which the frictional surface is spaced from a side surface of the support pole to permit vertical movement of the actuating handle whereby the hub is raised or lowered, and a second position with respect to the support pole in which the frictional surface engages the side surface of the support pole, the second position of the frictional surface being between the first position of the frictional surface and the side surface of the support pole at a given vertical position.

A further embodiment includes an umbrella canopy frame comprising a first elongate support member, at least a second elongate support member slidably engaged along an engagement region with the first elongate support member, a first junction attached to the first elongate support member, at least a second junction attached to the second elongate support member, a canopy support structure extending generally radially outward from the first and second junctions and interconnecting the first and second junctions in an articulating manner, and an erection assembly engaged with the first and second elongate support members and longitudinally securable with respect to the first elongate support member such that, in a securing position, the erection assembly forms a friction engagement to inhibit sliding movement to fix the first and second junctions in a set canopy opening position and such that, in an opening/lowering position, releases the friction engagement such that a user actuation force applied substantially along the engagement region induces the first and second elongate support members to slide with respect to each other to adjust the set canopy opening position.

In one embodiment, an umbrella is provided that includes a support pole assembly, a canopy support frame, and an actuating handle. The support pole assembly includes a lower pole and an upper pole. The lower pole has a lower end and an upper end. The upper pole is vertically translatable relative to the lower pole. The canopy support frame includes an upper hub, a lower hub, and a middle hub. The upper hub is coupled with the upper pole and with a plurality of ribs. The lower hub is coupled with the ribs. The middle hub is coupled with the lower pole and with the ribs. The actuating handle is coupled with the upper pole and is translatable relative to the lower pole so that, when the actuating handle is raised, the upper pole and the upper hub are raised causing the canopy support frame to close.

Certain embodiments of the invention include an umbrella assembly having a support pole and an actuating handle which can move longitudinally or slide with respect to the support pole to open or close a canopy of the umbrella. A plurality of support ribs or staves support and are connected to a flexible canopy to provide shade and shelter in an open position or configuration. In certain embodiments, the support ribs or staves are pivotably connected in an articulated manner with a plurality of hubs or junctions in which the support ribs or staves nest. In one embodiment, an opening/closing member interconnects the actuating handle and a first hub such that longitudinal or sliding movement of the actuating handle induces corresponding movement in the first hub or junction.

The articulated connection of the plurality of hubs with the support ribs or staves provides mechanical advantage in some embodiments to reduce the force needed to be applied to the actuating handle to raise or lower the canopy. The articulation also reduces a throw or manipulation distance required to raise or lower the umbrella.

In one embodiment, the actuating handle cooperates with a first hub in tension such that a first longitudinal force applied to the actuating handle induces the canopy to open or expand to an open position and a second opposed longitudinal force allows the canopy to collapse or retract to close. The second longitudinal or opposed force can be assisted by gravity, depending upon the particular orientation of the umbrella assembly.

Certain embodiments also comprise a frictional engagement actuated by the actuating handle such that the frictional engagement can be employed to inhibit movement of the support ribs or staves so as to secure the umbrella in a set open configuration. The frictional engagement also can be released to facilitate adjustment of the set open configuration, e.g., to further open or to close or collapse the canopy. In one embodiment, transition between engaged and released positions of the frictional engagement is achieved via rotation of the actuating handle. In one embodiment, the rotation of the actuating handle occurs about an axis arranged substantially perpendicular to the longitudinal axis of the support pole.

In certain embodiments, an umbrella includes an actuating handle that has an active and a neutral configuration or operational mode. In one embodiment, in an active configuration, actuation of the actuating handle operatively engages, e.g., moves, the frictional engagement to either release or engage the frictional engagement. In the neutral configuration, the actuating handle is decoupled or operatively disengaged from the frictional engagement such that the actuating handle can be manipulated without affecting the engagement/release of the frictional engagement. These embodiments provide the advantage that the actuating handle can be manipulated in one operational mode to engage or release a securing mechanism and can also be adjusted in another operational mode to a neutral configuration. When in the neutral configuration, the actuating handle can be positioned in a symmetric and aesthetically pleasing arrangement without affecting the degree of release or engagement of the securing mechanism.

DETAILED DESCRIPTION OF THE PREFERRED EMBODIMENT

Figure 1:
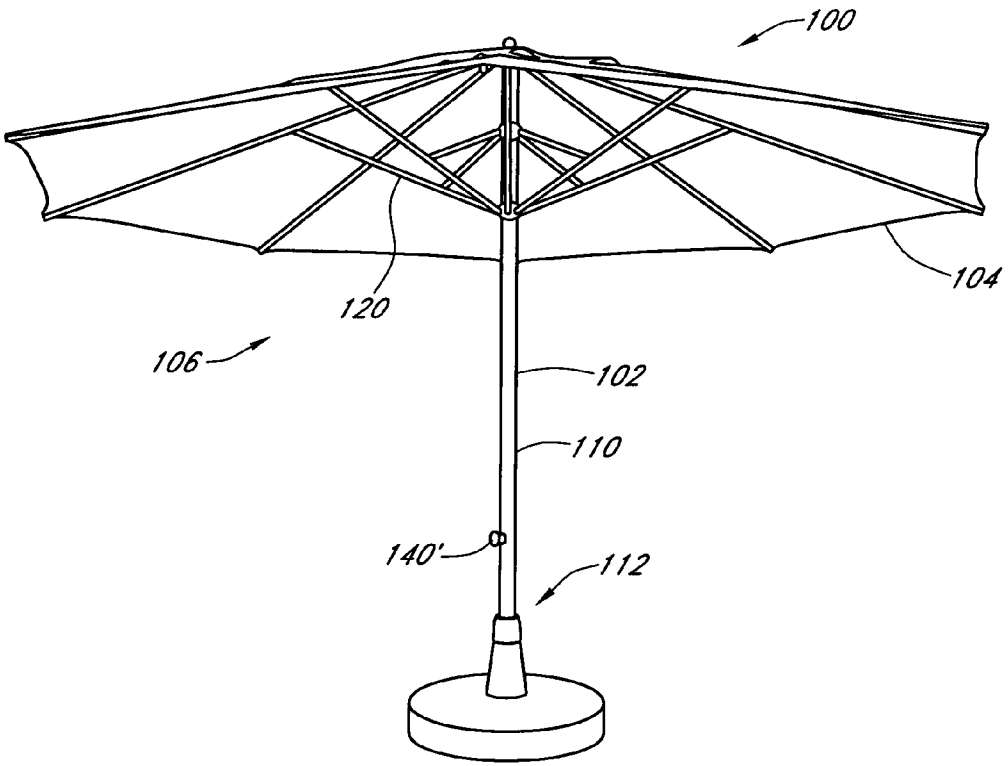
FIG. 1 is a perspective view of one embodiment of an umbrella having an opening/closing device with the umbrella in an erect, expanded, or open configuration.
Figure 3:
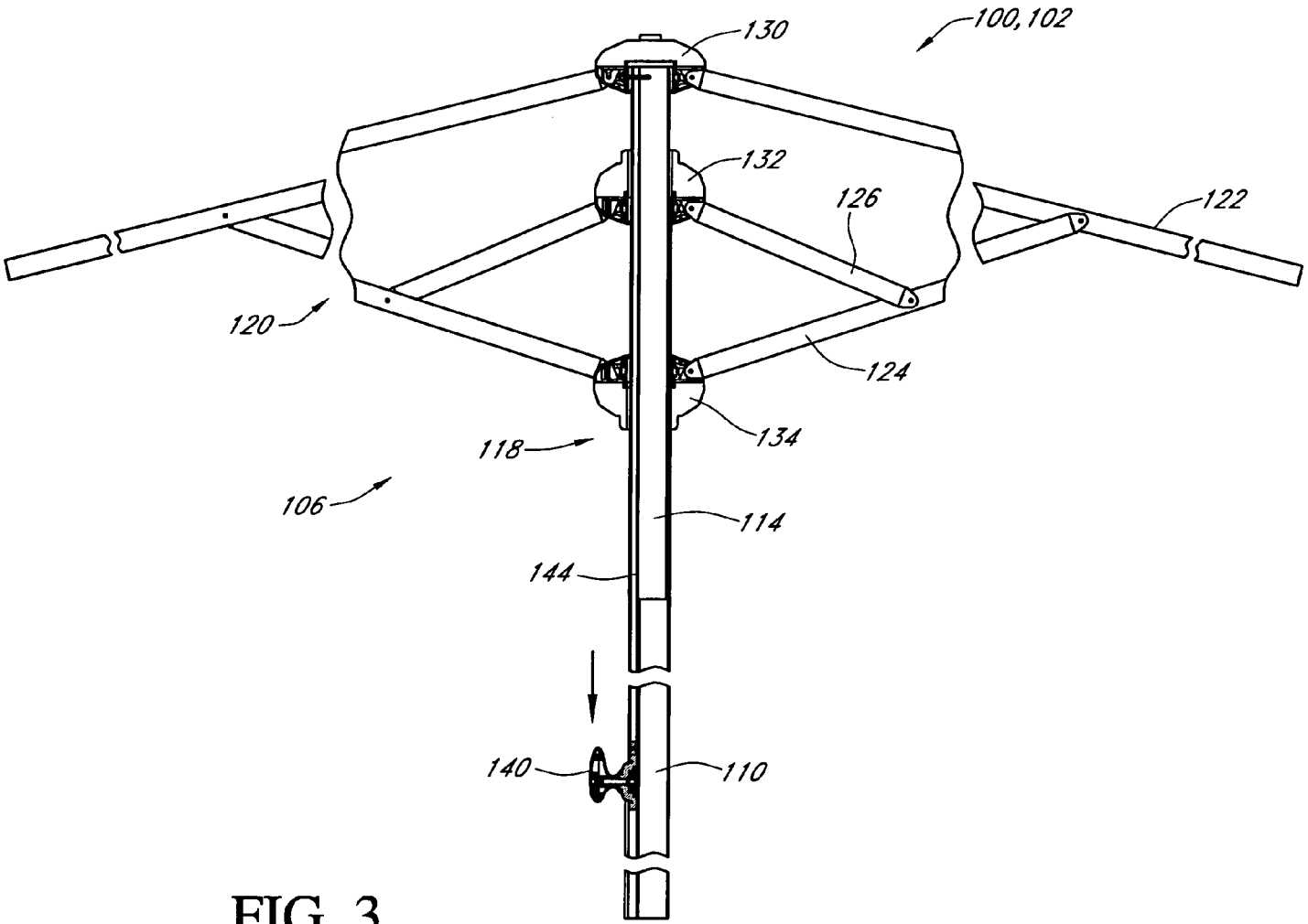
FIG. 3 is a cross-sectional view of one embodiment of a frame assembly for an umbrella taken through a longitudinal central portion of the frame assembly, the frame assembly and umbrella being shown in an open or erect configuration.

FIG. 1 illustrates in perspective view one embodiment of an umbrella or umbrella assembly 100. The umbrella assembly 100 is illustrated in FIGS. 1 and 3 in an open or erect configuration 106 that provides shade and shelter from the elements to users of the umbrella assembly 100. The umbrella assembly 100 can also be positioned in a closed or collapsed configuration 108 as illustrated in partial section view in FIG. 4.

In this embodiment, the umbrella assembly 100 comprises a frame assembly 102 and a canopy 104 which is attached to and supported by the frame assembly 102. The canopy 104 can comprise an at least partially flexible material, such as fabric and/or a plastic film. The canopy 104 offers shade protection from incident sunlight, as well as at least partial shelter from the elements, e.g., rain, bird droppings, tree sap, etc. The canopy 104 also can comprise materials having weather and sun resistant characteristics to provide extended durability and usage in outdoor settings. The canopy 104 also can be provided in an attractive color scheme or pattern and/or with a logo or other design to the user's taste.

Figure 4:
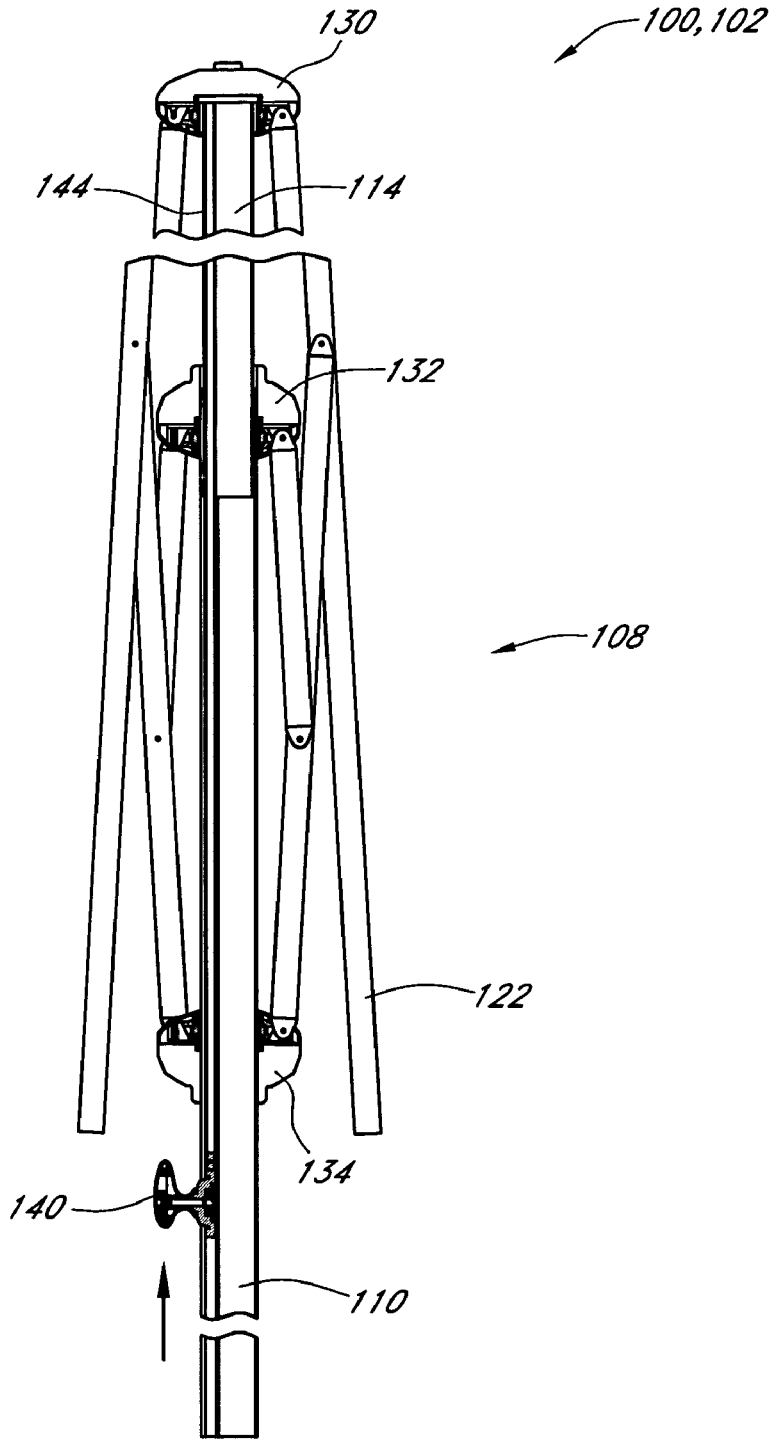
FIG. 4 is a cross-sectional view of the embodiment FIG. 3, the frame assembly and umbrella being shown in a closed or collapsed configuration.
Figure 5:
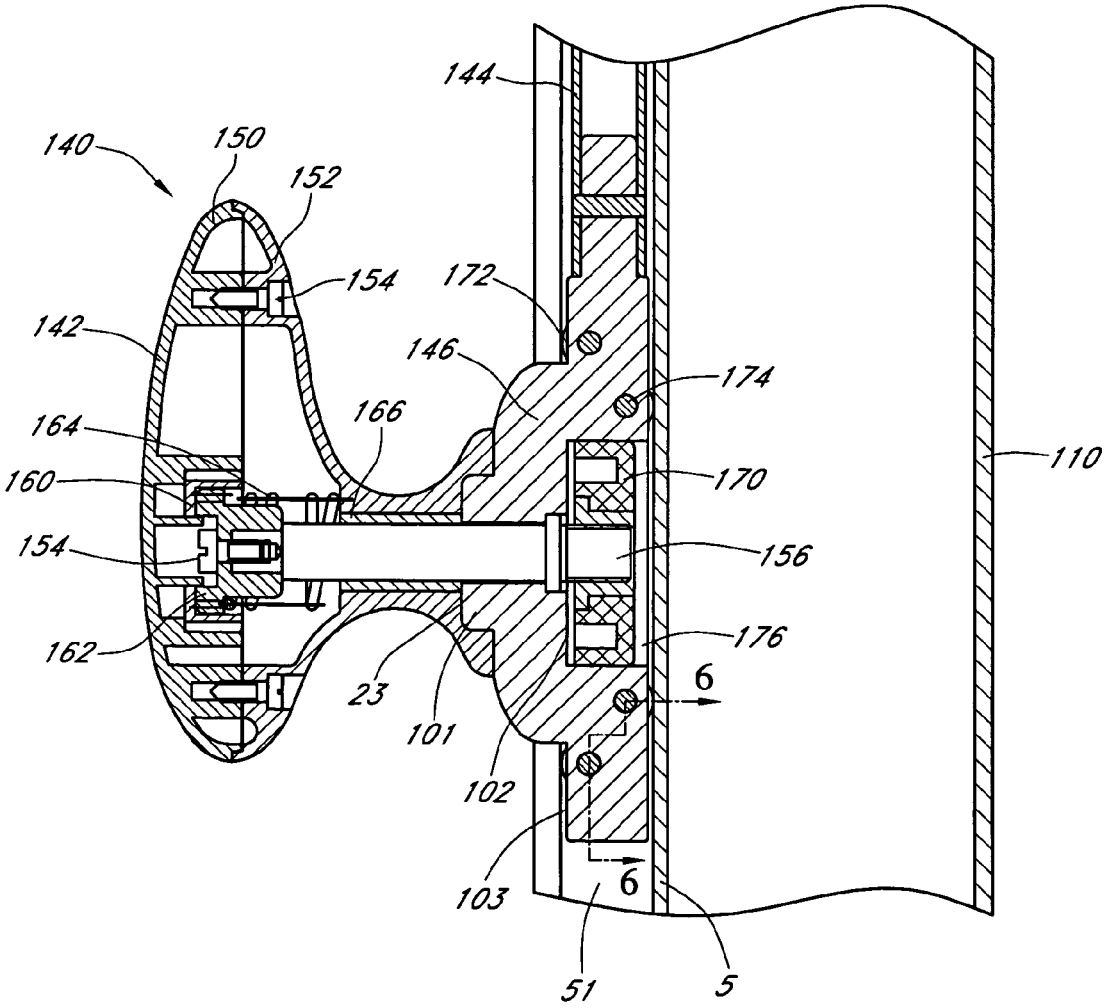
FIG. 5 is a vertical cross-sectional view of another embodiment of an actuating and securing mechanism for an umbrella.

The frame assembly 102 is in this embodiment designed and constructed to raise or open the canopy 104, as illustrated in FIGS. 1 and 3, as well as to lower or close the canopy as illustrated in FIG. 4. This aspect provides the advantage that the physical envelope encompassed by the umbrella assembly 100 in the closed configuration 108 is reduced to thereby facilitate storage, movement and/or packaging for shipment of the umbrella assembly 100. The frame assembly 102 also provides the ability to conveniently open the umbrella assembly 100 with attached canopy 104 when the umbrella assembly 100 is to be used. Several embodiments of the frame assembly 102 will be described with operating characteristics and advantages thereof discussed in greater detail below.

In one embodiment, the frame assembly 102 of the umbrella assembly 100 comprises a support pole or member 110. The support pole 110 is configured to support and elevate or extend the umbrella assembly 100 such that the extended canopy 104 can provide a sheltered and shaded region underneath. As discussed further below, the support pole 110 can be an assembly of a plurality of components. In some arrangements, the support pole 110 is a lower pole of a support pole assembly. In one embodiment, the support pole 110 is provided with a mounting end 112 which is adapted for attachment or mounting in place for use of the umbrella assembly 100. The mounting end 112 is a lower end of the support pole 110. FIG. 1 illustrates that one embodiment of the mounting end 112 is configured for attachment to a pedestal or base 113 which would typically be placed on and rest on the ground, a patio deck, a lawn, or the like. It will be understood that this is simply an illustration of one embodiment of the mounting end 112. In other embodiments, the mounting end 112 is configured for direct attachment or mounting in a patio, to a bracket on a vertically or horizontally extending building surface, or the like. The attachment of the mounting end 112 is in certain embodiments of a permanent or semi-permanent nature and in other embodiments comprises a releasable attachment. The attachment of the mounting end 112 in certain embodiments restrains both translation and rotation of the support pole 110. In other embodiments, the mounting end 112 is configured to allow limited rotational movement, e.g., a swiveling type movement. In yet other embodiments, the mounting end 112 is configured to accommodate rotation about multiple axes, e.g., in a pivoting type movement. In yet other embodiments, the attachment of the mounting end can be configured for translational movement, e.g., along a track or rail mount. Thus, it will be understood that the mounting end 112 is provided in certain embodiments to enable the umbrella assembly 100 to be conveniently mounted in place for use of the assembly 100.

The support pole 110 comprises a generally elongate rigid member which enables the frame assembly 102 to maintain the canopy 104 in an open or expanded configuration in a position distal from the mounting end 112 where the umbrella assembly 100 can be mounted in place. FIG. 1 illustrates one embodiment in which the support pole or member 110 is substantially straight or linear along the extent of the support pole 110. In other embodiments, the support pole or member 110 comprises both straight or linear portions, as well as curved portions. In yet other embodiments, the support pole or member 110 is curved substantially along an entire extent of the support pole or member. FIG. 1 also illustrates that one embodiment of the support pole or member 110 can be arranged in a substantially vertical orientation. However, in other embodiments, the support pole or member 110 can be arranged in an angled or diagonal orientation depending on the requirements of particular applications.

The frame assembly 102, including the component parts thereof, for example, including the support pole or member 110, preferably comprise relatively strong lightweight materials having suitable durability and weather resistant properties for the particular application of the umbrella assembly 100. Suitable materials for the frame assembly 102 can include but are not limited to light gauge corrosion resistant steels, aluminum alloys, titanium alloys, wood, plastics, carbon fiber materials, and/or other relatively high strength weather resistant materials as are well known. Appropriate selection of materials for construction of the frame assembly 102 can be at least partially dictated in particular applications by the desired aesthetic properties of the umbrella assembly 100, including the frame assembly 102. For example, in certain applications, desirable aesthetic qualities of the umbrella assembly 100 may indicate the use of finished or unfinished wood as components of the frame assembly 102, although other components may offer certain advantages in strength, weight, cost, or other characteristics. Thus, it will be appreciated that the materials selected for construction of the umbrella assembly 100 can vary in different applications and the selection of an appropriate material will be readily apparent to one of ordinary skill considering the disclosure and illustration of the subject application and the requirements of a particular application.

As illustrated in FIG. 1, the frame assembly 102 also comprises a canopy support structure 120. In some embodiments as discussed below, the canopy support structure 120 is a canopy support frame. The canopy support structure 120 extends generally radially outward from a central axis of the umbrella assembly 100. In one implementation, the central axis is defined by a major or longitudinal axis of the support pole or member 110. The canopy support structure 120 is articulated such that the canopy support structure 120 can extend into an open or expanded configuration 106 as illustrated in FIG. 1 and can further be collapsed or closed to a configuration 108, for example, as illustrated in FIG. 4.

FIGS. 1 and 8-12 illustrate that the umbrella assembly 100 includes an actuating or expansion assembly or handle 140'. A user can open and close the umbrella assembly 100 and the canopy support structure 120 in this embodiment by actuating the actuating assembly 140'. The actuating handle 140' enables a user to apply force by hand to release the frame assembly 102 from a secured or stowed configuration. When the frame assembly 102 is released, the umbrella assembly 100 can be opened or closed.

The actuating assembly 140' is of a simple mechanical structure, yet is able to open and close the umbrella assembly 100 with a relatively low force. This is a significant advantage for smaller and weaker users. The actuating assembly 140' avoids complex mechanisms and thus reduces susceptibility to foreign material contamination and corrosion. The actuating assembly 140 also offers aesthetic advantages which will be described in greater detail along with the operational advantages of the actuating assembly 140' following a more detailed description of the component structure of the assembly 140'.

FIGS. 2-7 illustrate an actuating assembly 140 that is one variation of the actuating assembly 140'. The actuating assembly 140 enables repositioning of a hand-gripping portion thereof without disengaging a frictional engagement 180, as discussed below.

Figure 2:
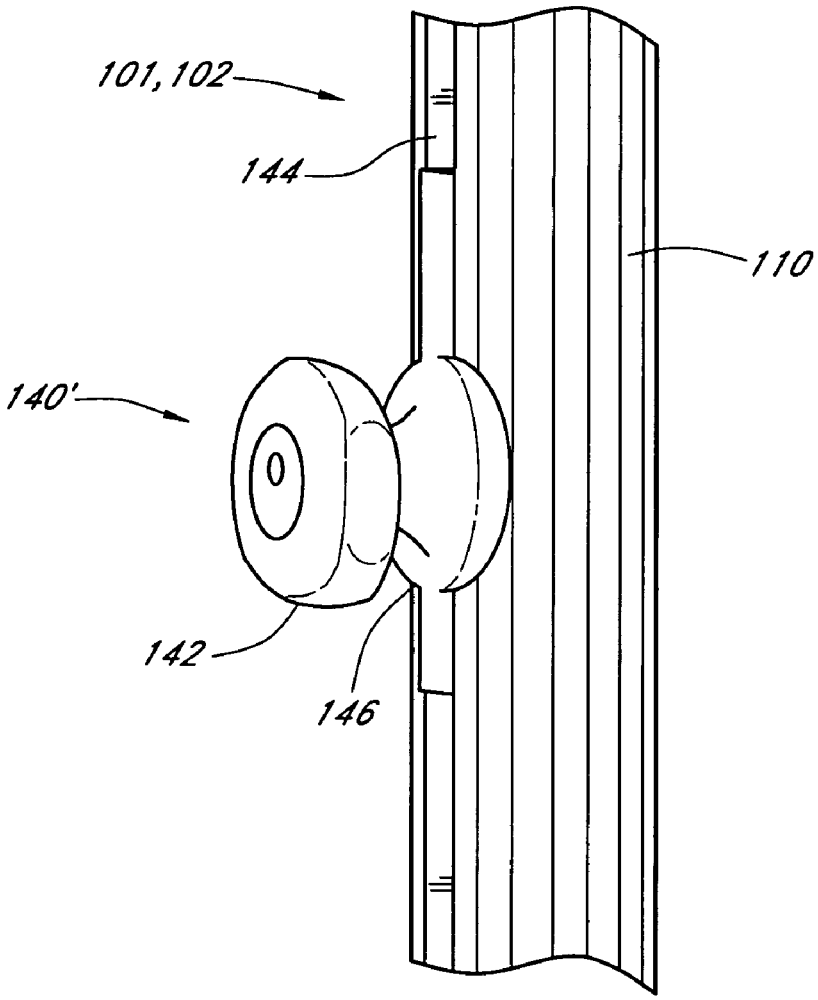
FIG. 2 is a perspective view of one embodiment of an actuation assembly for an umbrella opening/closing device.

FIG. 2 illustrates in side section view one embodiment of a frame assembly 102 in greater detail. As previously noted, in one embodiment, the frame assembly 102 includes a support pole or member 110 configured to support and extend the canopy 104 of the umbrella assembly 100. The frame assembly 120 can be raised or lowered via hand manipulation of the actuating assembly 140. In this embodiment, an upper pole 114 is provided that is vertically translatable relative to the support pole 110. In one embodiment, the upper pole 114 fits with the support pole 110 in a male-female arrangement which inhibits transverse translation of the upper pole 114 relative to the support pole 110 while permitting longitudinal or sliding movement, e.g., along a major or longitudinal axis thereof. In one embodiment, the support pole or member 110, together with the upper pole 114 define an engagement region 118 within which the two poles 110, 114 are engaged. In the embodiment of FIGS. 1 and 3, the engagement region 118 is substantially straight or linear. In other embodiments, the support pole 110 and upper pole 114 can have a cooperating curvature such that a curved engagement region 118 still permits longitudinal sliding between the two poles 110, 114.

The frame assembly 102 further comprises a first hub or junction 130, a second hub or junction 132, and a third hub or junction 124. The first hub or junction 130 is attached to the upper pole 114 in one embodiment, e.g., adjacent an upper end thereof. In one embodiment, the first hub 130 is mounted to the upper pole 114 such that both translation and rotation of the first hub 130 are restrained relative to the upper pole 114. In another embodiment, at least one of rotation and translation of the first hub 130 relative to the upper pole 114 is restrained. In another embodiment, one of rotation and translation of the first hub 130 relative to the upper pole 114 is restrained. In some arrangements, the first hub 130 is an upper hub that is coupled with a plurality of ribs in one embodiment.

The second hub or junction 132 is coupled with, e.g., mounted to, an upper end of the support pole 110. The upper end of the support pole 110 is an end opposite of the mounting end 112. In this embodiment, the second hub 132 also is attached to restrain at least one of, e.g., both of, translation and rotation of the second hub 132 relative to the support pole 110. In one embodiment, the second hub 132 is a middle hub that is coupled with a lower pole, which can be the support pole 110.

As discussed further below, the third hub or junction 134 is coupled with one or more ribs of the canopy support structure 120. The third hub 134 also can be coupled with the support pole 110. As discussed further below, the third hub 134 can be arranged to slide along a portion of the support pole 110 in one embodiment. The third hub 134 can also be located at a position intermediate the second hub 132 and the mounting end 112 of the support pole 110. Thus, in one embodiment, the first hub 130 is arranged at one end of the umbrella assembly 100 opposite from the mounting end 112. The second hub 132 and third hub 134 are positioned intermediate the first hub 130 and the mounting end 112, with the second hub 132 being further interposed between the first hub 130 and the third hub 134.

The third hub 134 can be coupled with the support pole 110 such that rotation of the third hub 134 relative to the support pole 110 is restrained. Preferably, the coupling of the third hub 134 with the support pole 110 permits vertical movement, e.g., along the longitudinal axis of the support pole 110. This arrangement restrains horizontal or transverse translation of the third hub 134 relative to the support pole 110. The third hub 134 is attached to the support pole 110 in a manner which allows controlled translation of the third hub 134 longitudinally or along a major axis of the support pole 110.

As previously mentioned, in one embodiment, the umbrella assembly 100 can be opened and/or closed via manipulation of the actuating assembly 140. In one embodiment, the actuating assembly 140 is configured to be slidably interconnected with the support pole or member 110. The actuating assembly 140 is further interconnected with the first hub 130 via an actuating member 144. In one arrangement, the actuating member 144 comprises an upper pole of a support pole assembly. In this embodiment, longitudinal force or force applied along the major axis of the support pole 110 to the actuating assembly 140 is communicated via the actuating member 144 to the first hub 130. A longitudinal force applied to the actuating assembly 140 in a direction away from the first hub 130 along the support pole 110 or generally in a direction towards the mounting end 112, as indicated by the downwardly pointing arrow in FIG. 3, applies a tension force to the first hub 130 inducing the first hub 130 to follow the motion of the actuating assembly 140. An opposite force applied to the actuating assembly 140 applies a compressive force to the actuating member 144, which transfers the force to the first hub 130 to induce the frame assembly 102 to collapse or close as illustrated in FIG. 4.

In one embodiment, the actuating member 144 comprises a generally elongate rigid or semi-rigid member interconnecting the actuating assembly 140 and the first hub 130. However, in other embodiments the actuating member 144 acts in tension and a cable is used to interconnect the actuating assembly 140 and the first hub 130. As in certain embodiments, the actuating assembly 140 and actuating member 144 connected to the first hub 130 operate in tension. These embodiments avoid the bending and binding of rigid or semi-rigid members of structures in which an elongate member is subjected to compression forces. Such mechanisms employing compressive forces also typically preclude the utilization of cables, ropes, and chains as these are typically not capable of effectively transferring a compression force.

A further advantage of certain embodiments of the umbrella assembly 100 and frame assembly 102 thereof are that gravity and the weight of the umbrella assembly 100 can assist in at least one of the opening and closing the umbrella assembly 100. More particularly, when embodiments of the umbrella assembly 100 are arranged in a generally vertical orientation, e.g., when the support pole 110 is arranged generally vertically, gravitational forces act upon the mass of the components of the umbrella assembly 100, urging these components downward. For example, as illustrated in FIG. 4, a limited restraining force can be applied along the longitudinal extent of the support pole 110 to control the closing of the umbrella assembly 100 with gravity assisting the collapse of the frame assembly 102. In use, a force less than the weight of the user may be applied to the actuating assembly 140 in a generally downward direction to induce the opening or erection of the umbrella assembly 100. Preferably, raising or opening of the umbrella assembly 100 requires relatively little muscular exertion as the user can simply use a portion of their body weight to apply a generally downward force to the actuating assembly 140, e.g., by leaning on the actuator assembly. This facilitates use of a relatively large umbrella assembly 100 by those of relatively small stature and/or limited strength or by the physically impaired.

Further advantages to the opening and closing of the umbrella assembly 100 are provided by the arrangement of the canopy support structure 120. More particularly, in one embodiment, the canopy support structure 120 comprises a plurality of mounting ribs or staves 122 which are interconnected with a corresponding plurality of first erection members 124 and second erection members 126. Each of the mounting ribs or staves 122 and the first and second erection members 124, 126 extend generally radially outward from a centerline or central axis of the umbrella assembly 100, e.g., of the frame assembly 102. The mounting ribs or staves 122 are positioned generally at an upper extent of the canopy support structure 130 to support attachment points for the canopy 104. The mounting ribs or staves 122 extend substantially the radial extent or to the peripheral edge of the canopy 104 in one embodiment. Proximal ends of the mounting ribs 122 can be pivotably connected or nested in the first hub 130. Distal ends of the first erection members 124 can be pivotably connected along intermediate points to the mounting ribs 122. Proximal ends of the first erection members 124 can be pivotably connected or nested in the third hub or junctions 134. Distal ends of the second erection members 126 can be pivotably connected to intermediate points of the first erection members 124 with proximal ends of the second erection members 126 being pivotably connected or nested with the second hub 132 in some embodiments.

Thus, the first hub 130 can be controllably moved longitudinally relative to the second hub 132 via manipulation of the actuating assembly 140 and the actuating member 144. The third hub 134 is free to slide longitudinally relative to the second hub 132, e.g., along the support pole 110, in one embodiment. The mounting ribs 122 and the first and second erection members 124, 126 are pivotably connected with each other and with the first, second, and third hubs 130, 132, 134 to define an articulating mechanism. Moving the first and third hubs 130, 134 relative to the second hub 132 will close or collapse, or open or raise respectively the canopy support structure 120 and the attached canopy 104.

Appropriate selection of the relative lengths of the mounting ribs 122 and first and second erection members 124, 126, as well as the location of corresponding intermediate points of the mounting ribs 122 and first erection members 124 to which the first erection members 124 and second erection members 126 are respectively interconnected, provide mechanical advantage. Providing mechanical advantage can further reduce the force required to be applied to the actuating assembly 140 to raise or lower the umbrella assembly 100. As previously noted, in some embodiments, gravity can assist in at least one of opening and closing of an umbrella, e.g., the umbrella assembly 100. In other embodiments, the umbrella assembly 100 defines a substantially balanced or weight neutral configuration. For example, the relative weight, placement, and mechanical leverage ratios of the components of the umbrella assembly 100 can be arranged such that gravity induces the assembly 100 to open or to close. The umbrella assembly 100 can also be constructed such that weight loads are substantially balanced such that, absent an opening or closing applied force, the umbrella assembly 100 is balanced and not induced to either close or open.

In one embodiment, an umbrella assembly 100 of an approximate open height of one hundred and fifteen inches (approximately 292 centimeters) and having a canopy diameter of approximately thirteen feet (approximately 396 centimeters) can be readily opened or closed by an ordinary user (e.g., one of average strength). In one embodiment, the umbrella assembly 100 can have approximate closed height of one hundred and forty inches (approximately 356 centimeters). This is achieved in part by providing mounting ribs 122, first erection members 124, and second erection members 126 of a suitable configuration. For example, the length of the ribs 122 is about eighty inches (about 203 centimeters) in one embodiment. The length of the first erection members 124 is about thirty-seven inches (about 94 centimeters) in one embodiment. The length of the second erection members 126 is sixteen inches (about 41 centimeters) in one embodiment. Each of the first erection members 124 is attached to a corresponding rib 122 at about forty-four inches (about 112 centimeters) from the proximal end of the rib 122. Each of the second erection members 126 is attached to a corresponding first erection member 124 at about twenty-one inches (about 53 centimeters) from the proximal end of the first erection member 124.

Other size umbrellas can be constructed that can be easily opened by an ordinary user. For example, in one embodiment the ribs 122 are constructed with a length that is about equal to two times the length of the erection members 124. In another embodiment, the ribs 122 are constructed with a length that is more than two times the length of the erection members 124. In another embodiment, the erection members 124 are constructed with a length that is about equal to two times the length of the erection members 128. In one embodiment, the erection members 124 are constructed with a length that is more than two times the length of the erection members 126. In another embodiment, the ribs 122 are constructed with a length that is about equal to four times the length of the erection members 126. In another embodiment, the ribs 122 are constructed with a length that is more than four times the length of the erection members 124.

Other arrangements also facilitate umbrella operation by an ordinary user. For example, in one embodiment the ribs 122 are connected to the erection members 124 by a pivoting joint that is located a distance more than half the length of the ribs 122 from the proximal end of the ribs 122. In another embodiment, the erection members 124 are connected to the erection members 126 by a pivoting joint that is located a distance more than half the length of the erection member 124 from the proximal end of the erection member 124. In another embodiment, the ribs 122 are connected to the erection members 124 by a pivoting joint that is located closer to the distal ends of the ribs 122 than to the proximal ends thereof and the erection members 124 are connected to the erection members 126 by a pivoting joint that also is located closer to the distal ends of the erection member 124 that to the proximal ends thereof.

FIG. 4 shows additional components and details of one embodiment of the actuating assembly 140. In one embodiment, the actuating handle 142 is comprised of an actuating handle cover 150 and an actuating handle base 152 which are connected via one or more fasteners 154. An elongate shaft 156 passes through the actuating handle base 152 and engages with the actuating assembly base 146, discussed below. An outer gear 160 is engaged with the actuating handle 142 and an inner gear 162 is engaged with the shaft 156. A resilient member 164, which in one embodiment is configured as a coil spring, applies preload force that acts on at least one of the outer and inner gears 160, 162. The engagement of the actuating handle 142 with the outer gear 160 and the shaft 156 with the inner gear 162 is such that axial movement of the actuating handle 142 relative to the shaft 156 induces the outer and inner gears 160, 162 to engage or disengage each other. When the outer and inner gears 160, 162 are engaged, rotation of the actuating handle 142 is communicated to corresponding rotation of the shaft 156. When the outer and inner gears 160, 162 are disengaged, the actuating handle is free to rotate without corresponding rotation of the shaft 156.

The end of the shaft 156 opposite the actuating handle 142 engages with a securing piece 170 in a spiral thread or cam manner such that rotation of the shaft 156. For example rotation of the actuating handle 142 induces the securing piece to translate radially inward or outward from a surface of the support pole 110. The securing piece 170 fits with radial clearance within a receiver region 148, discussed below, and within a recess 176 of the base 146. Appropriate rotation of the shaft 156 thus induces the securing piece to translate radially so as to contact the receiver region or contour 148 of the support pole 110 at either an inner or outer location or with clearance in an intermediate position.

When the securing piece 170 is engaged with the support pole 110, a frictional engagement 180 is formed between the securing piece 170 and the pole 110. The frictional engagement 180 is arranged generally inwardly with respect to a centerline (e.g., a central or longitudinal axis) of the support pole 110. In another embodiment, a frictional engagement could be located outwardly from the centerline of the support pole 110. When the shaft 156 is rotated to urge the securing piece 170 into a frictional engagement 180, the securing piece and the shaft 156, actuating handle 142, and base 146 are frictionally engaged with the support pole 110 to inhibit sliding or translational movement relative to the pole.

As discussed above, the actuating assembly 140 is connected with the actuating member 144 and with the first hub 130. When the actuating assembly 140 is engaged to form the frictional engagement 180, the configuration of the umbrella assembly 100 (e.g., the degree of opening) is fixed. To release the frictional engagement 180, the actuating handle 142 is turned to turn the shaft 156 whereby a threaded or cam engagement with the securing piece 170 laterally translates the securing piece to release the frictional engagement 180.

Figure 8:
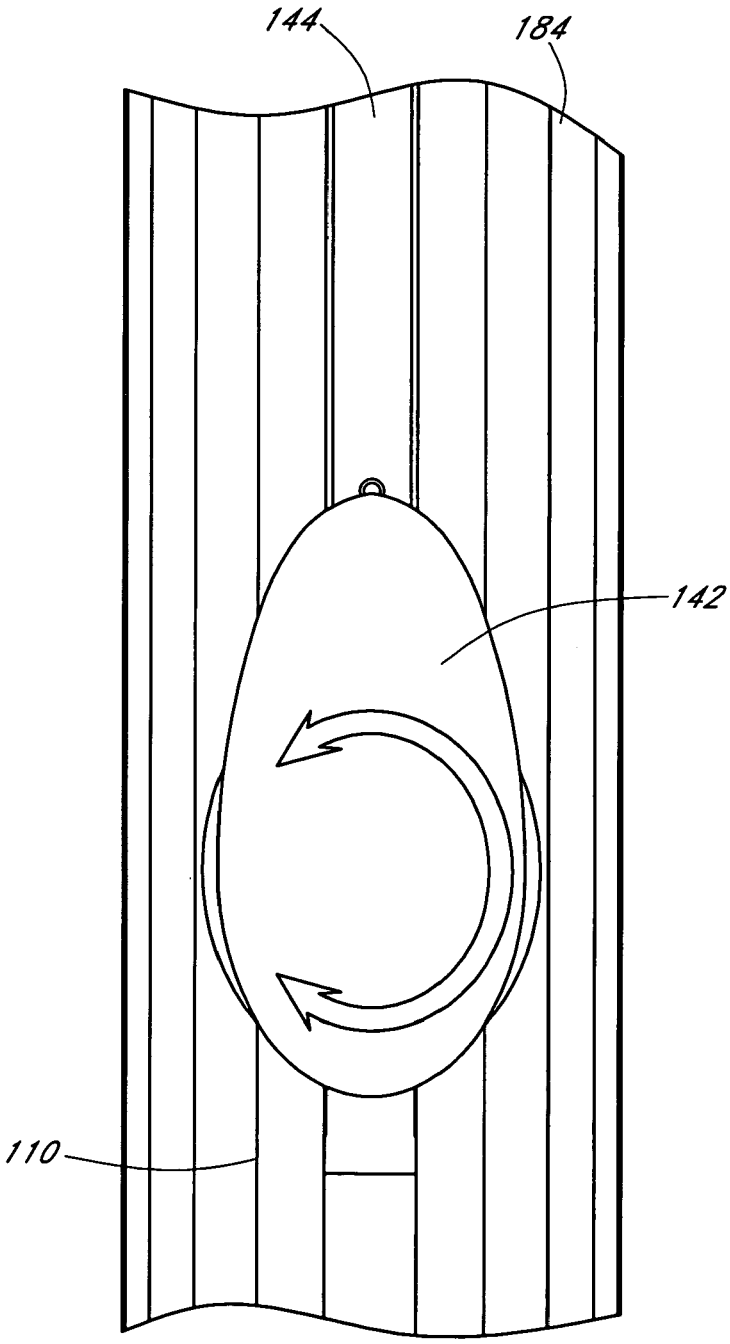
FIG. 8 is a side view of one embodiment of the actuating and securing mechanism of FIG. 5.
Figure 9:
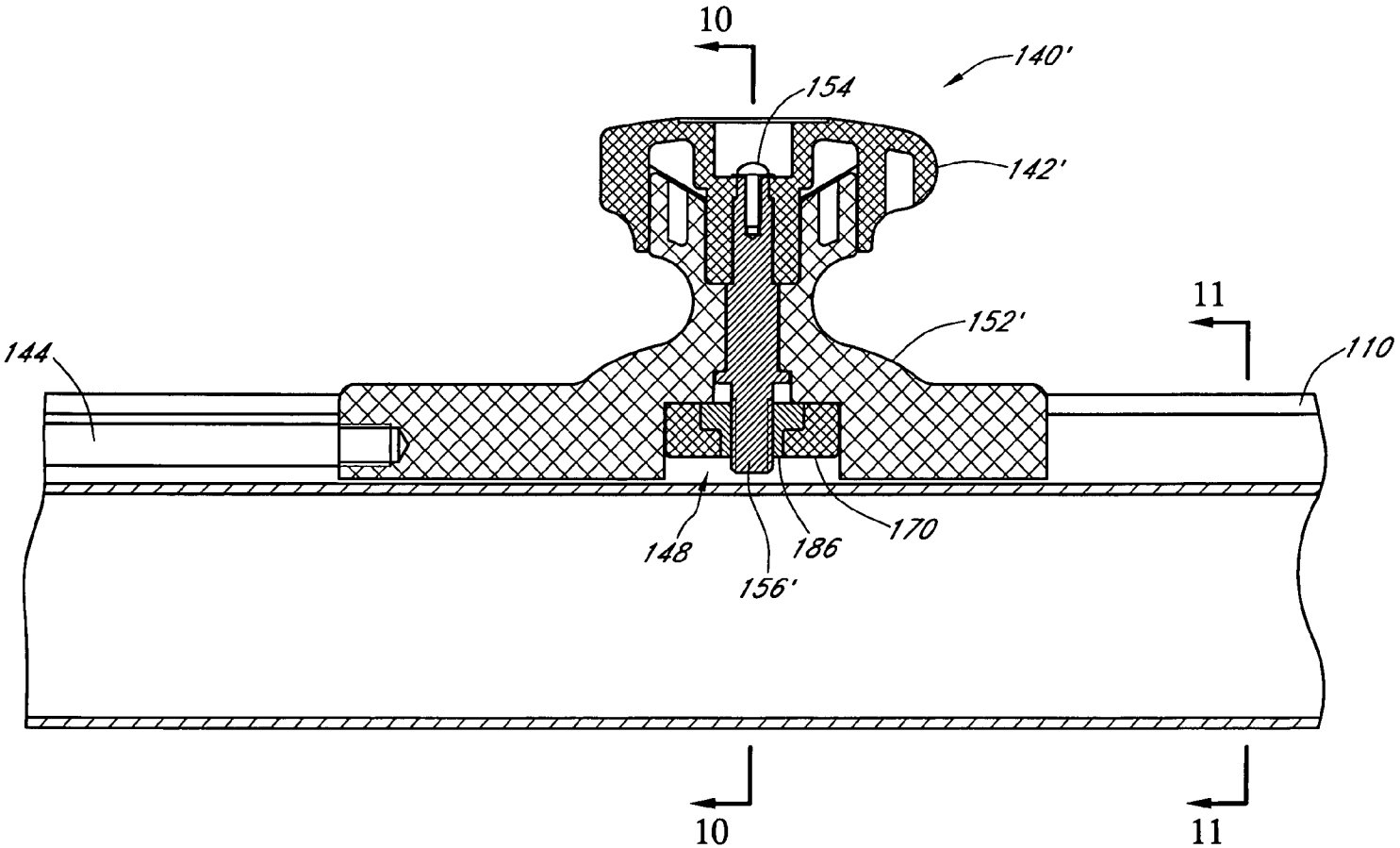
FIG. 9 is a vertical cross-section view of the actuation assembly of FIG. 2.
Figure 11:
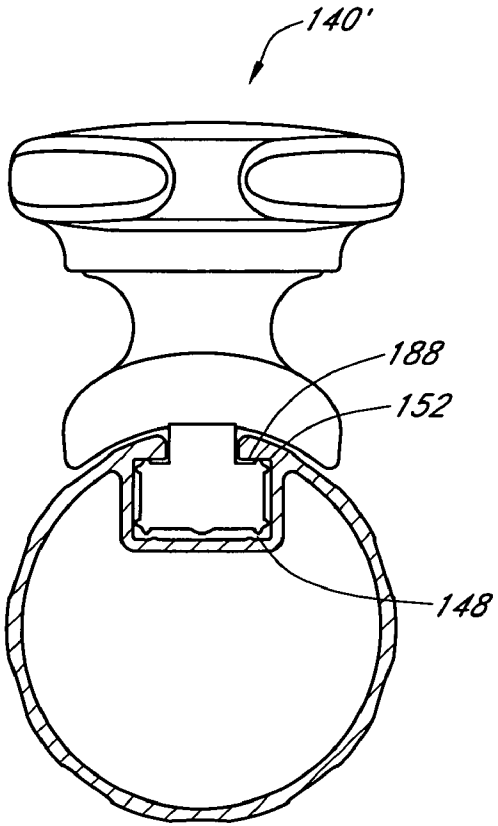
FIG. 11 is a cross-sectional view of FIG. 9 taken at section plane 11-11.
Figure 10:
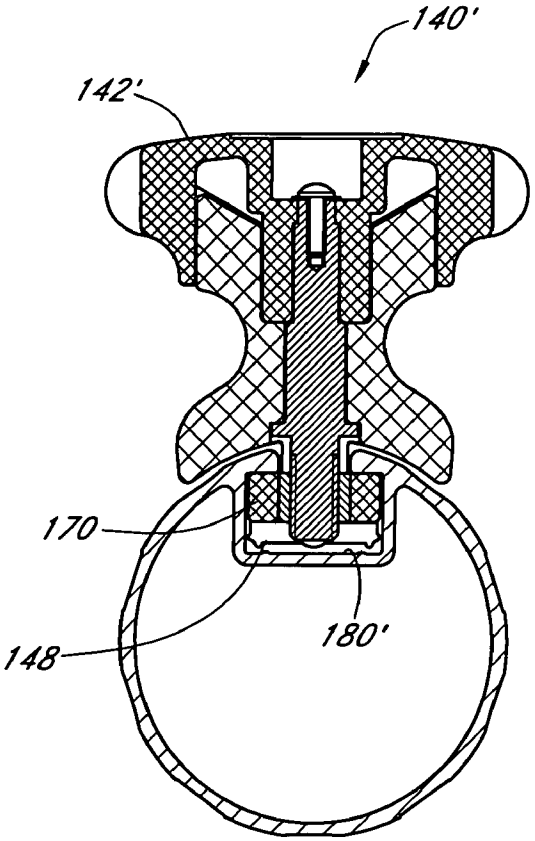
FIG. 10 is a cross-sectional view of FIG. 9 taken at section plane 10-10.
Figure 12:
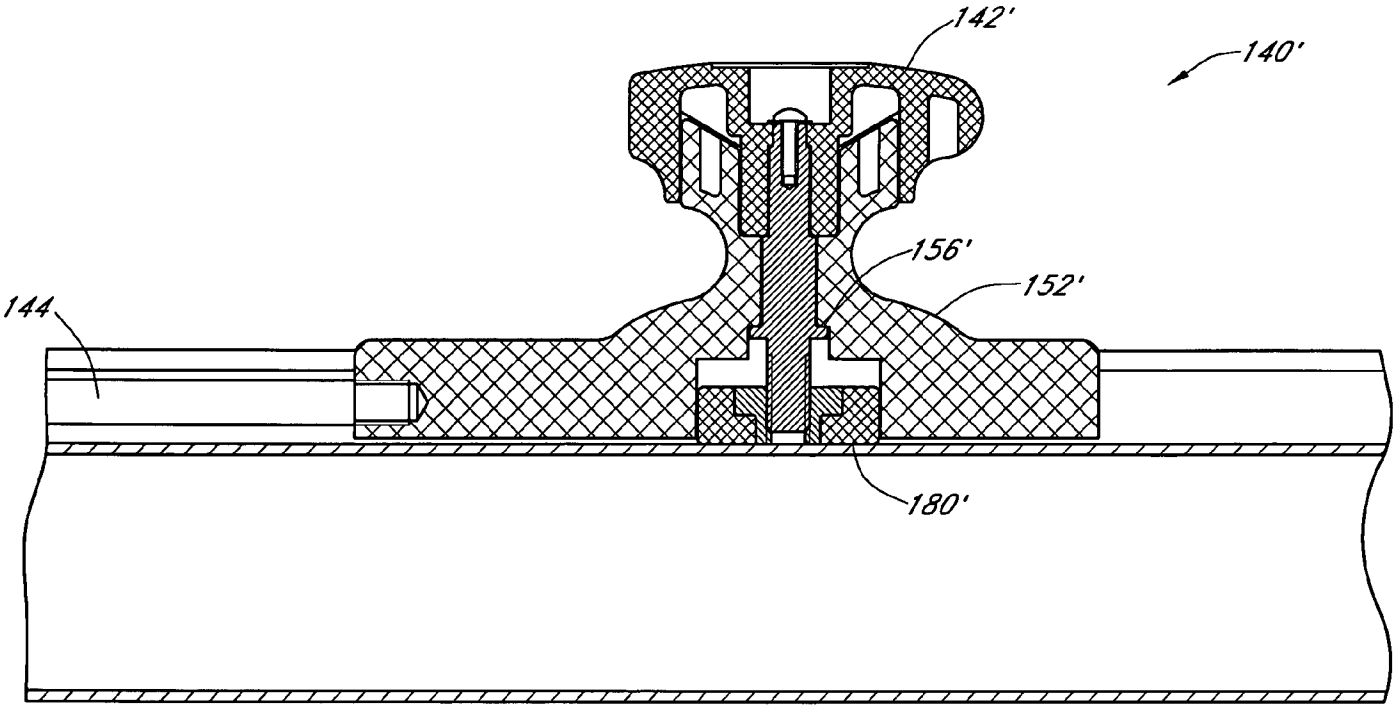
FIG. 12 is a vertical cross-section similar to FIG. 9 showing another configuration of the actuating and securing mechanism.

One advantage of certain embodiments of the actuating assembly 140 is that the actuating handle 142 can be moved independently of the shaft 156. More particularly, as previously noted, the actuating handle 142 can be translated laterally or axially along the shaft 156 to engage or disengage the outer and inner gears 160, 162. Thus, when the actuating handle 142 is manipulated to engage the gears 160, 162, the shaft 156 can be manipulated to engage or release the frictional engagement 180. Upon achieving the desired engagement or release of the frictional engagement, the actuating handle 142 can be further manipulated to disengage the gears 160, 162. The actuating handle 142 can then be manipulated to a selected orientation, e.g., an aesthetically pleasing orientation, without further change to the set configuration of the frictional engagement 180. One example of an aesthetically pleasing symmetric orientation is shown in FIG. 8. This rearranging of the actuating handle 142 can be achieved without affecting a secured or released configuration of the actuating assembly 140. This provides the advantage that asymmetric or variable mechanical appearances can be eliminated or minimized for various configurations of the umbrella assembly 100.

It will be appreciated that the arrangement of the actuating handle 142 and shaft 156 with the associated gears 160 and 162 can be adapted to the requirements of particular applications, including whether a pull or push force, e.g., movement away from or towards the support pole 110, is required to engage or disengage the gears 160, 162. Similarly, the engagement of the shaft 156 with the tightening piece 170 may be adapted to require relatively small movements or relatively large movements based again on the anticipated application of the umbrella assembly 100 and the capabilities of anticipated users thereof.

Figure 7:
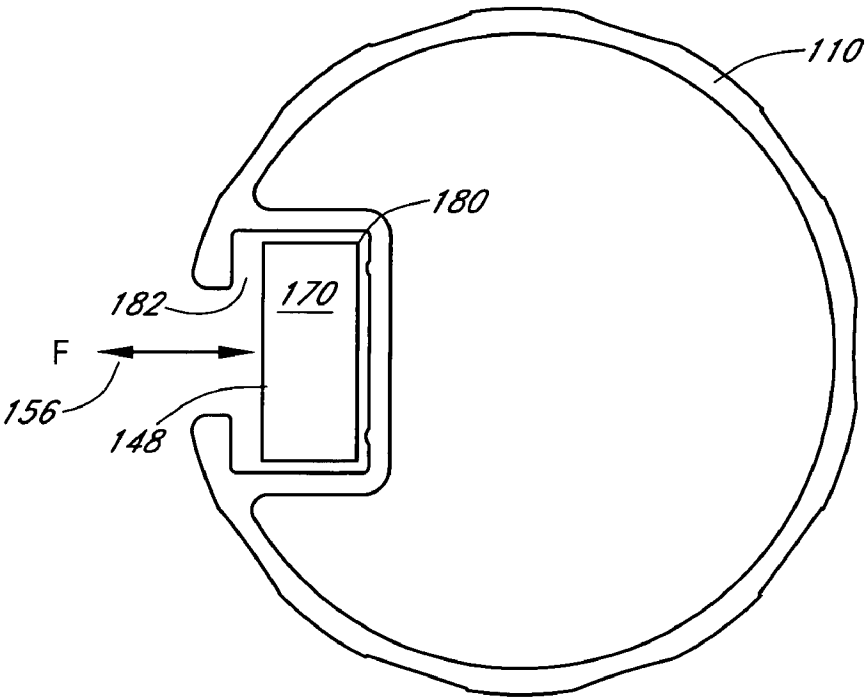
FIG. 7 is a schematic illustration of a securing piece and a support pole having a receiving area.
Figure 6:
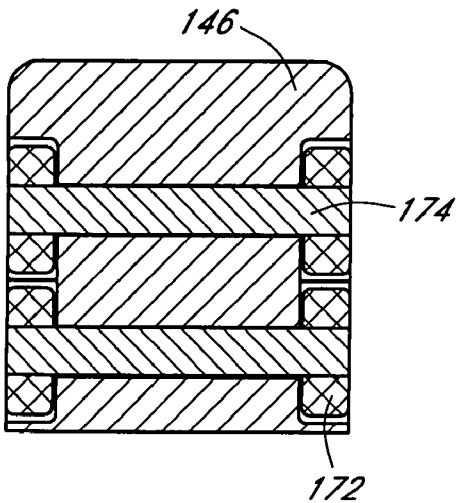
FIG. 6 is a cross-sectional view taken at section plane 6-6 in FIG. 5 of a sliding member with rollers, the sliding member located in a receiving area of a support pole illustrated schematically in FIG. 7.

In one embodiment, the receiver region or contour 148 defines an undercut region 182. The undercut region 182 provides the advantage of further maintaining the securing piece 170 and base 146 within the receiver region 148. The undercut region 182 also facilitates arranging frictional engagement at either the inner or outer regions of the receiver region 148. In one embodiment, the undercut region 182 describes a generally "H" or "I" shaped contour. In this embodiment, a tension force applied by the shaft 156 as engaged with the securing piece 170, indicated $F_{156}$ in FIG. 7 is directed substantially perpendicular to the frictional engagement 180. In other embodiments, the undercut region 182 of the receiver region 148 can describe a dovetail, semi-cylindrical, or other undercut contour with corresponding contouring of the engaging surfaces of the securing piece 170.

Longitudinal or sliding movement of the base 146 of the actuating assembly 140 is further facilitated by a plurality of rollers or wheels 172. The rollers or wheels 172 are attached via corresponding axles 174 to the base 145 such that the rollers or wheels 172 are free to rotate to provide a rolling or wheeled contact between the base 146 of the actuating assembly 140 and the receiver region 148 of the support pole 110. Reduced friction in the actuating assembly 140 is also facilitated via placement of a bushing 166 between the shaft 166 and the actuating handle 142.

The mechanical advantage provided by the umbrella support assembly 120 also reduces the throw or distance which the actuating assembly 140 needs to move to raise or lower the umbrella.

FIG. 7 shows additional details of one configuration of the actuating handle 142 and a support pole 110. The support pole 110 comprises a plurality of longitudinally extending ribs or flutes 188. The dimensions and contours of the ribs or flutes 184 are comparable to the dimensions of the receiver region 148 and the actuating member 144 positioned therein. Thus, in this embodiment, the support pole 110 presents a more uniform consistent appearance about a circumference thereof which reduces the visual impact of the mechanical component of the actuating member 144. The actuating handle 142 in this embodiment is configured as a generally smoothly curved oblong or oval shape which can be arranged in a generally vertical orientation so as to present bilateral symmetry about a vertical axis to present an aesthetically balanced view to a user of the umbrella assembly 100. However, the actuating handle 142 also exhibits asymmetry about a horizontal or transverse axis (in the position illustrated) to present a visual indication of the orientation of the actuating handle 142, as well as to provide an enhanced grasping surface to facilitate hand manipulation of the actuating assembly 140.

FIGS. 8-12 illustrate further details of the actuating assembly 140' suitable for use with the umbrella assembly 100. The embodiment of actuating assembly 140' is similar in certain aspects with the previously described embodiments of assembly 140. Similar component parts and operational characteristics will not be repeated in detail for brevity and ease of understanding. In this embodiment, the actuating handle 142' differs by being continuously engaged with a shaft 156'. In this embodiment, the actuating assembly 140' comprises an actuating handle 142' configured for hand manipulation by a user. The actuating handle 142' can be an actuating handle. The external surface of the actuating handle 142' is preferably configured in an ergonomic manner to facilitate comfortable grasping by a user and in certain embodiments has bilateral symmetry to facilitate usage by either a right handed or left handed user. In certain embodiments, the actuating handle 142' also exhibits an asymmetric contour or characteristic to indicate the orientation of the actuating handle 142'. This provides functional and aesthetic advantages to the umbrella assembly 100 which will be described in greater detail below following a more detailed description of the component parts and operating of the actuating assembly 140' with the actuating handle 142'.

In this embodiment, the actuating assembly 140' also comprises a base 146'. The base 146' is configured to engage with the support pole 110 along a receiver region or contour 148 thereof (see FIGS. 7 and 9). The receiver region or contour 148 defines an elongate channel extending longitudinally or along a major axis of the support pole 110. The base 146' engages cooperatively with the receiver region or contour 148 of the support pole 110 to be retained therein in a manner allowing controlled longitudinal or sliding movement along the support pole 110. As previously noted, the actuating member 144 is between, and is connected in one embodiment to, the actuating assembly 140' and the first hub 130. Thus, user force applied to the actuating handle 142' induces the base 146' as well as the actuating member 144 to slide or longitudinally translate along the receiver region or contour 148 of the support pole 110. In this embodiment, the actuating member 144' also extends within the receiver region 148.

The actuating assembly 140' does not need to be selectively coupled or decoupled from the actuating handle 142' with the shaft 156'. The embodiment of actuating assembly 140' offers even greater simplicity in construction and manufacture as well as simplified use.

In a similar manner to that previously described for the assembly 140, in this embodiment, rotation of the actuating handle 142' induces the shaft 156' to corresponding rotation. The shaft 156' is threaded together with or engaged in a cam type arrangement with a securing structure 170. Rotation of the actuating handle 142' induces the shaft 156' to turn to thereby induce the securing structure 170 to translate laterally inward or outward within the receiver region 148. This engages or disengages a frictional engagement 180' (see FIGS. 10 and 12) depending on the direction of movement of the actuating handle 142' and the particular configuration of the actuating assembly 140'. The actuating assembly 140' can thus secure the umbrella assembly 100 in place or be utilized to achieve a desired opening/closing configuration as previously described.

The actuating assembly 140' also differs in having an alternative configuration of engagement between the actuating handle base 152' and the receiver region 148 of the support member 110. In one embodiment, the actuating handle base 152' comprises a low-friction coating or layer 188 arranged on outer surfaces of the actuating handle base 152' and more particularly to region of engagement between the actuating handle base 152' and the receiver region 148. The actuating handle base 152' can have, but does not require, rollers or axles. The actuating assembly 140' of this embodiment thus offers further additional simplification in structure and manufacture as compared to the assembly 140. Appropriate selection of an embodiment of an actuating assembly 140, 140' can be readily made by one of ordinary skill based in part on the intended application of the umbrella assembly 100 and the desired price point of the final product.

The actuating assembly 140' further differs in having a different configuration of the actuating handle 142'. In this embodiment, the actuating handle 142' describes generally a radially symmetrical structure. In one embodiment, the actuating handle 142' is generally configured as an equilateral triangle with rounded or flattened vertices. The actuating handle 142' can thus exhibit symmetry about a vertical or a horizontal axis independent of the particular orientation of the actuating handle 142'. In yet other embodiments, the actuating handle 142' is generally circular in contour and can include flutes or knurling as additional ergonomic and/or aesthetic enhancements. The actuating handle 142' can also be provided with distinctive lettering, coloring, or other designations to indicate the orientation of the actuating handle 142' to facilitate user actuation of the actuating handle 142' to a desired position. Thus, in these embodiments, the actuating handle 142' exhibits generally radial symmetry such that no usual operational orientation of the actuating handle 142' presents a distinctive unpleasing asymmetry.

Figure 13:
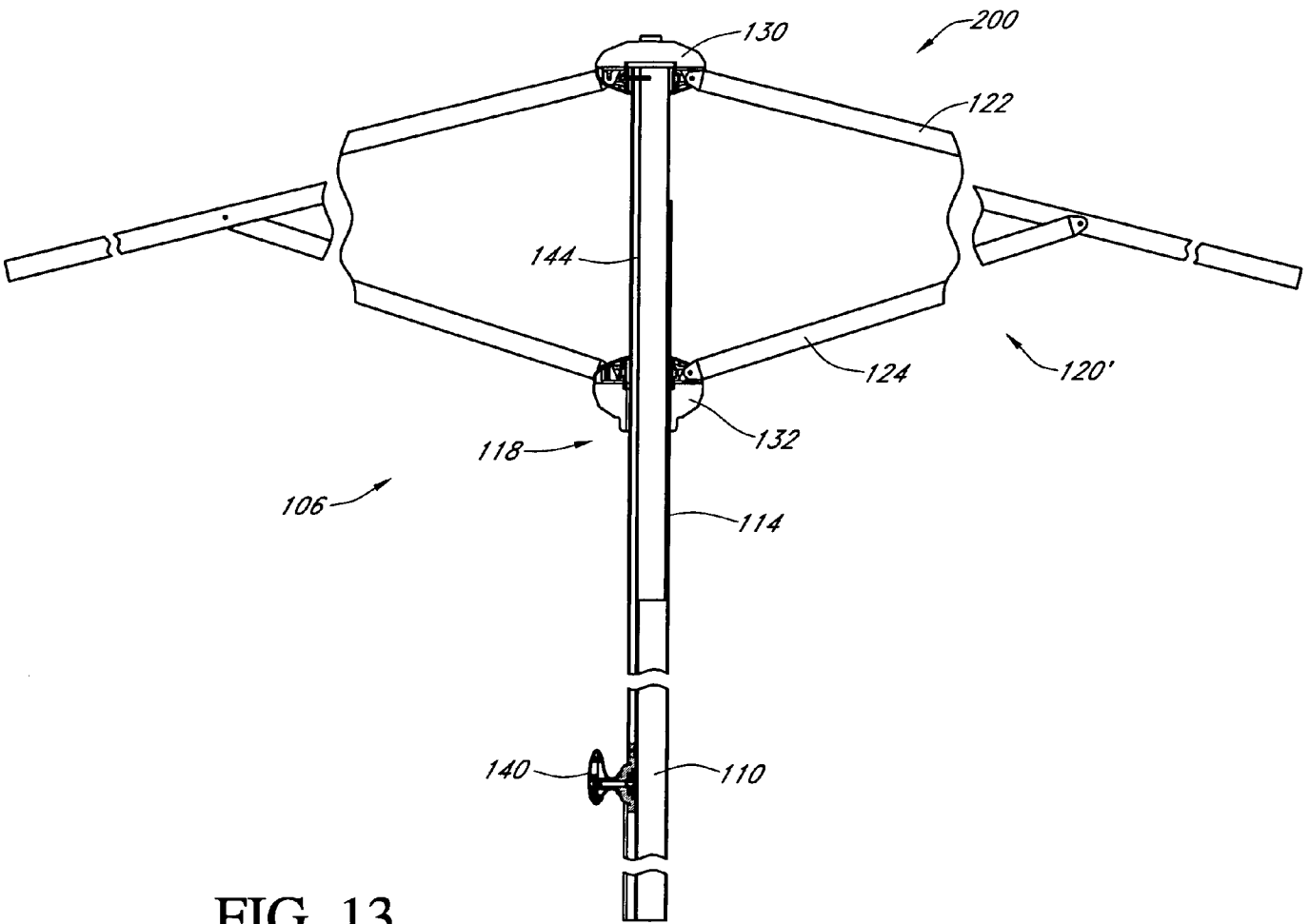
FIG. 13 is a vertical cross-sectional view of another embodiment of a frame assembly for an umbrella in an open or erect configuration.
Figure 14:
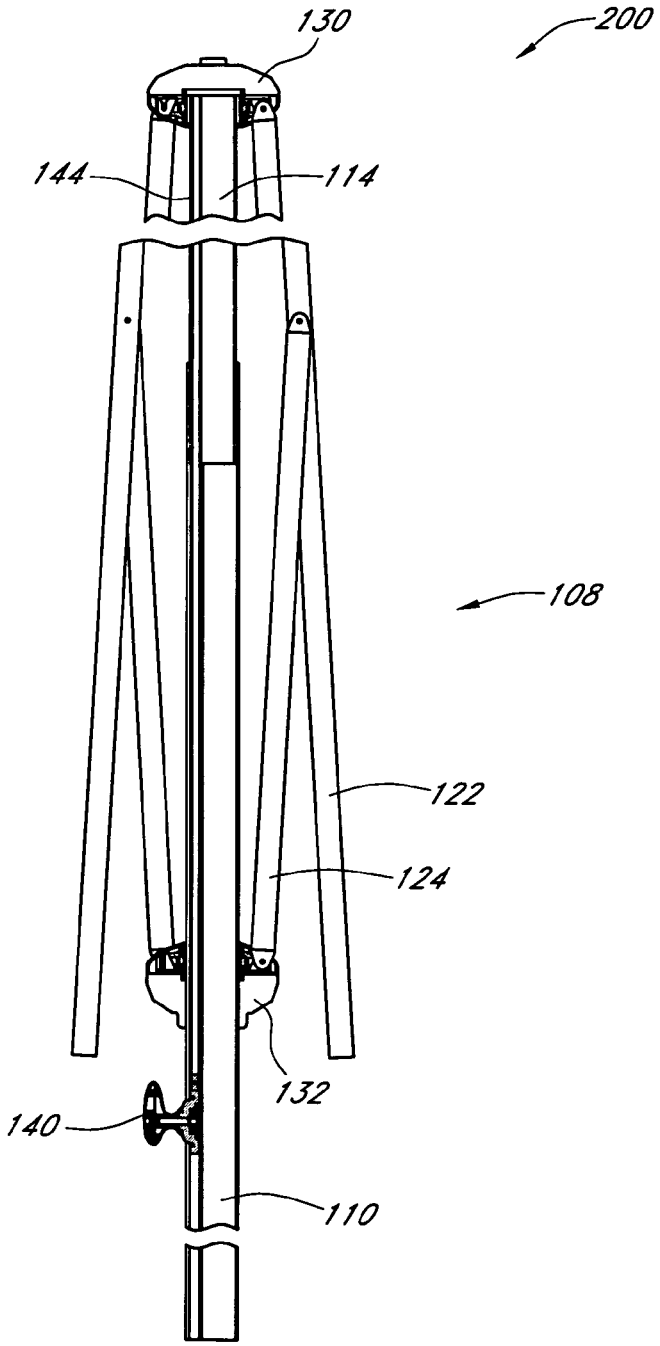
FIG. 14 is a vertical cross-sectional view of the embodiment illustrated by FIG. 13 in a closed or collapsed configuration.

FIGS. 13 and 14 illustrate in side section view another embodiment of an umbrella assembly 200 shown in an open configuration 106 in FIG. 13 and in a closed configuration 108 in FIG. 14. The embodiment illustrated in FIGS. 13 and 14 shares many similarities in operation and component parts with the previously described embodiments of the umbrella assembly 100. Similar operational characteristics and components will not be described in detail for brevity and ease of understanding.

The embodiment of an umbrella assembly 200 illustrated in FIGS. 13 and 14 differs in the construction of a canopy support structure 120' that need not include three hubs. For example, in one embodiment, the canopy support structure 120' can be constructed with the third hub 134 and associated second erection members 126. Thus, in this embodiment, a first hub 130 is pivotably engaged with a plurality of mounting ribs or staves 122 configured for attachment to and support of an umbrella canopy 104. In this embodiment, the second hub 132 is similarly pivotably connected with a corresponding plurality of first erection members 124 which are pivotably connected at an opposite end to corresponding mounting ribs 122. An upper pole 114 is similarly coupled with the support pole 110 along an engagement region 118 whereby slideable or longitudinal movement between the upper pole 114 and the support pole 110 is accommodated. In a similar manner to the umbrella assembly 100 embodiments previously described, an actuating assembly (e.g., the actuating assembly 140 or the actuating assembly 140') engages with an actuating member 114 to couple with the first hub 130. Appropriate force applied longitudinally along the support pole 110 can draw the first hub 130 into adjacency with the second hub 132, which is fixed in elevation, so as to erect the umbrella assembly 200. An opposing force can be applied to the actuating assembly (e.g., to the actuating assembly 140 or the actuating assembly 140') to allow the first hub 130 to be separated from the second hub 132 to achieve the closed configuration 108, for example, as illustrated in FIG. 14.

The embodiments of umbrella assembly 200 offer the advantage of reduced parts count and even simpler mechanical construction than the previously described embodiments of the umbrella assembly 100. The mechanical advantage provided by the umbrella assembly 200, for example, in opening and closing operations of the assembly 200 is lower than in the previously described embodiments of the umbrella assembly 100. Thus, the umbrella assembly 200 is more suitable where the weight loading of the umbrella 200 is lower or in applications wherein the anticipated physical capabilities of users are sufficient for easy operation of the umbrella assembly 200 with the lower mechanical advantage of this mechanism.

Thus, the various embodiments previously described of umbrella assemblies 100 and 200 provide a particularly simple and easy to implement mechanical structure for the opening and closing operations of the umbrellas assemblies 100 and 200. Cluttered or mechanical appearing mechanisms are avoided or shielded from user view. Actuating mechanisms are of a particularly simple to use construction and present an appealing symmetrical appearance to an observer. A variety of mechanical advantage mechanisms are provided which can be utilized and adjusted to provide mechanical advantage for particular weight characteristics and user capabilities of a variety of applications.

Although the above disclosed embodiments of the present teachings have shown, described and pointed out the fundamental novel features of the invention as applied to the above-disclosed embodiments, it should be understood that various omissions, substitutions, and changes in the form of the detail of the devices, systems and/or methods illustrated may be made by those skilled in the art without departing from the scope of the present teachings. Consequently, the scope of the invention should not be limited to the foregoing description but should be defined by the appended claims.

This disclosure includes all permutations of the independent claims with their dependent claims.

What is claimed is:

1. An umbrella, comprising:

a support pole assembly comprising:

a lower pole having a lower end and an upper end;

an upper pole vertically translatable relative to the lower pole;

a canopy support frame comprising:

an upper hub coupled with the upper pole and with a first plurality of ribs, each rib of the first plurality of ribs having a proximal end coupled with the upper hub and a distal end spaced therefrom;

a lower hub coupled with a second plurality of ribs, each rib of the second plurality having a proximal end coupled with the lower hub and a distal end coupled with one of the first plurality of ribs; and a middle hub coupled with the lower pole and with a third plurality of ribs, each of the third plurality of ribs having a proximal end coupled with the middle hub and a distal end coupled with one of the second plurality of ribs; and an actuating handle coupled with the upper pole and translatable relative to the lower pole so that, when the actuating handle is raised, the upper pole and the upper hub are raised causing the canopy support frame to close;

wherein the umbrella comprises:

a closed configuration corresponding to a raised position of the actuating handle, the upper pole, and the upper hub, a substantially fully open configuration corresponding to a lowered position of the actuating handle, the upper pole, and the upper hub, and a weight-balanced configuration corresponding to an intermediate position between the closed and fully open position of the actuating handle, the upper pole, and the upper hub, in which the weight loads of the umbrella are substantially balanced such that absent an opening or closing force, the umbrella is neither induced to open or close, the intermediate position being disposed between and spaced from the raised and lowered positions of the actuating handle, the upper pole, and the upper hub.

2. The umbrella of claim 1, wherein the actuating handle is coupled with the support pole assembly for translation along an axis parallel to a longitudinal axis of the support pole assembly.

3. The umbrella of claim 1, wherein the actuating handle has a first position transverse to the support pole assembly in which the actuating handle is spaced from a side surface of the support pole assembly to permit vertical movement of the actuating handle, said vertical movement raising or lowering the upper hub, and a second position transverse to the support pole assembly in which the actuating handle frictionally engages a side surface of the support pole assembly to inhibit vertical movement of the actuating handle.

4. The umbrella of claim 1, wherein the actuating handle comprises a hand-gripping portion and a frictional surface moveable into engagement with the side surface of the support pole assembly.

5. The umbrella of claim 4, wherein the actuating handle is configured such that rotation of the hand-gripping portion causes the frictional surface to move transversely to the support pole assembly into engagement with the support pole assembly and out of engagement with the support pole assembly.

6. The umbrella of claim 4, wherein the hand-gripping portion is symmetrical about an axis extending transverse to the support pole.

7. The umbrella of claim 4, wherein the hand-gripping portion can be moved independently of the frictional surface.

8. The umbrella of claim 7, wherein the hand-gripping portion can be manipulated to couple or decouple movement of the hand-gripping portion and the frictional surface.

9. The umbrella of claim 1, wherein the actuating handle further comprises a hand-gripping portion and a frictional surface, the actuating handle having a first position with respect to the support pole assembly in which the frictional surface is spaced from a side surface of the support pole assembly to permit vertical movement of the actuating handle whereby the upper hub is raised or lowered, and a second position with respect to the support pole assembly in which the frictional surface engages the side surface of the support pole assembly, the second position of the frictional surface being between the first position of the frictional surface and the side surface of the support pole assembly at a given vertical position.

10. The umbrella of claim 9, wherein the actuating handle is configured such that rotation of the hand-gripping portion moves the actuating handle between the first and second positions.

11. The umbrella of claim 9, wherein the hand-gripping portion is symmetrical about an axis extending transverse to the support pole assembly.

12. The umbrella of claim 9, wherein the hand-gripping portion can be disengaged from the frictional surface to permit the hand-gripping portion to be moved independently of the frictional surface.

13. The umbrella of claim 9, wherein the upper hub is connected adjacent to the upper end of the upper pole portion, and wherein the lower hub is slideable relative to the support pole assembly and the middle hub is connected to an upper end of the lower pole portion.

14. The umbrella of claim 13, wherein the middle hub maintains a constant elevation as the upper hub is raised.

15. The umbrella of claim 9, further comprising an elongate member having a lower end coupled with the actuating handle and an upper end coupled with the upper hub such that vertical movement of the actuating handle is transferred through the elongate member to the hub causing vertical movement of the upper hub.

16. The umbrella of claim 15, wherein the support pole assembly comprises an elongate channel in which the elongate member moves as the actuating handle moves.

17. The umbrella of claim 16, further comprising at least one roller positioned between the elongate member and the elongate channel.

18. An umbrella, comprising:

a support pole assembly comprising:

a lower pole having a lower end and an upper end;

an upper pole vertically translatable relative to the lower pole;

a canopy support frame comprising:

an upper hub coupled with the upper pole and with a first rib having a first end coupled with the upper hub;

a lower hub coupled with a second rib having a first end coupled with the lower hub; and a middle hub coupled with the lower pole and with a third rib having a first end coupled with the middle hub and a second end coupled with the second rib; and an actuating handle coupled with the upper pole and translatable over a travel distance relative to the lower pole between a fully open position and a fully closed position, wherein, when the actuating handle is raised, the upper pole and the upper hub are raised causing the canopy support frame to close;

the actuating handle moving from the fully open position to an only partially closed position without application of force to the actuating handle whereby a throw distance over which force is required to be applied to the actuating handle to fully close the umbrella is less than the travel distance.

19. The umbrella of claim 18, further comprising an elongate member having a lower end coupled with the actuating handle and an upper end coupled with the upper hub such that vertical movement of the actuating handle is transferred through the elongate member to the hub causing vertical movement of the upper hub.

20. The umbrella of claim 19, wherein the support pole assembly comprises an elongate channel in which the elongate member moves as the actuating handle moves.

21. An umbrella, comprising:

a support pole having an upper portion, a lower portion, and an elongate channel;

a plurality of ribs for supporting an umbrella canopy;

an upper hub coupled with the upper portion of the support pole and with at least one of said ribs;

a lower hub mounted on the support pole below the upper hub at a fixed elevation;

a follower hub having a body and an aperture configured to receive the support pole, the follower hub being located below the upper hub and below the lower hub, the follower hub being movable along the support pole between a first position and a second position, the second position being between the first position and the location of the lower hub;

an actuating assembly located below the follower hub for directly driving the upper hub, the actuating assembly comprising:

a handle positioned at a location below the follower hub; and an elongate member coupled at a first end with the handle and at a second end with the upper hub, the elongate member disposed to move in the elongate channel of the support pole and through the aperture of the follower hub;

wherein the handle, the elongate member, and the upper hub move vertically in unison, the upper hub moving upward in response to a closing force being applied to the handle at a weight neutral position of the handle to cause upward movement of the handle from the weight neutral position to close the umbrella, the upper hub moving downward in response to an opening force being applied to the handle at the weight neutral position of the handle to cause downward movement of the handle from the weight neutral position to open the umbrella;

wherein the handle, elongate member, and the upper hub are not induced to move from the weight neutral position absent an opening or closing force being applied to the handle by the user; and wherein the follower hub is indirectly driven by the transmission of forces through at least one of said ribs between the first and second positions.

22. The umbrella of claim 21, further comprising a mechanism including a first frame element connected to the lower hub at a first end and to a second frame element at a second end, the second frame element coupled at a first end with the follower hub and at a second end with one of said plurality of ribs, the mechanism enhancing the mechanical advantage of the umbrella.

23. The umbrella of claim 22, wherein a position of the connection of first frame element with the second frame element is selected to enhance the mechanical advantage of the umbrella such that a force acting at the second end of the second frame element is greater than a force applied to the handle.

* * * * *